US007665631B2

(12) United States Patent
Pikowski

(10) Patent No.: US 7,665,631 B2
(45) Date of Patent: Feb. 23, 2010

(54) DOUBLE CHAMBER VARIABLE CONDIMENT DISPENSER BOTTLE

(76) Inventor: Dan Pikowski, 365 E. Richmond, Westmont, IL (US) 60559

( * ) Notice: Subject to any disclaimer, the term of this patent is extended or adjusted under 35 U.S.C. 154(b) by 333 days.

(21) Appl. No.: 11/605,645

(22) Filed: Nov. 29, 2006

(65) Prior Publication Data

US 2008/0121654 A1 May 29, 2008

(51) Int. Cl.
*B67D 5/56* (2006.01)

(52) U.S. Cl. ..... 222/129; 222/94; 222/144.5

(58) Field of Classification Search ..... 222/129, 222/92, 94, 107, 142.1–142.9, 144.5, 145.1, 222/480, 481

See application file for complete search history.

(56) References Cited

U.S. PATENT DOCUMENTS 1,331,444 A * 2/1920 Lowry ..... 222/142.8
1,563,917 A * 12/1925 O'Brien ..... 222/142.6
2,652,951 A * 9/1953 Esposito et al. ..... 222/142.1
3,235,130 A * 2/1966 Waither et al. ..... 222/142.9

* cited by examiner

*Primary Examiner*—Lien T Ngo

(57) ABSTRACT

A dual chamber liquid condiment bottle utilizes a rotatable valve above each chamber to adjust the amount of liquid condiment released when squeezing the bottle. Each rotatable valve has a finger tab to adjust the amount of condiment released. Because condiments are often composed of different viscosities, such as mustard and ketchup, or oil and vinegar for salads, it is advantageous to have the adjustments for each chamber to release the desired ratio of the condiments when simultaneously dispensing them.

3 Claims, 2 Drawing Sheets

DOUBLE CHAMBER VARIABLE CONDIMENT DISPENSER BOTTLE

BACKGROUND OF THE INVENTION

1. Field of the Invention

This invention generally pertains to liquid condiment dispensers. Specifically, this invention describes a dual chamber condiment bottle with a dispensing nozzle provided for each chamber that provides for variable dispensing of the contents of each chamber as the bottle is squeezed. The amount of each chamber's contents to be dispensed can be adjusted during the dispensing process. This feature allows fluids of different viscosities to have adjustable dispense rates suitable to the user.

2. Description of the Prior Arts

It is very common to store individual condiments in separate containers that also serve as dispensing containers when they are squeezed. Several different condiments are often used at one time, requiring picking up and squeezing a number of separate containers. In large food service settings, such as those found in schools, hospitals, and stadiums, for example, a large number of separate condiment containers can become unwieldy and time consuming to use. This is especially true when a large number of people are being fed simultaneously.

Salad dressings also can be used in multiple combinations, such as vinegar in one dispenser and oil in another dispenser. The oil, having a higher viscosity than vinegar, flows more slowly when dispensed through a given nozzle opening than does vinegar when dispensed through the same nozzle opening. The relatively lower viscosity of vinegar compared to oil means that the vinegar requires a smaller nozzle opening to produce near equal volumes of oil and vinegar on a salad, for example. Further, the nozzle opening should be adjustable during dispensing to suit individual oil and vinegar proportions according to one's tastes.

It is also common for dispensers to use relatively small caps to seal the ends of the dispensing nozzles. Because of their relatively small size, these caps can be easily dropped and contaminated or lost completely. Often it can be time consuming to determine which cap goes on which nozzle. These problems are amplified in large food service settings where time is further wasted in handling a large number of conventional condiment dispensers.

A U.S. Pat. No. 4,148,417, issued to Simmons features a squeeze dispenser with at least two compartments, each compartment having a nozzle to expel the contents of each compartment. The nozzles are the same size, therefore not allowing for contents of different viscosities to flow equally or in proportions desired by the user. If one compartment contains oil, and the other vinegar, the vinegar will flow more freely, releasing much more vinegar than oil in unwanted proportions. The same holds true for a common thin, yellow mustard and thicker ketchup. The inability to control the size of the nozzle opening presents difficulty when dispensing contents with dissimilar viscosities.

A U.S. Pat. No. 4,193,521, issued to Bounds is a two compartment condiment dispenser with two outlets intended for particulate contents, such as salt and pepper. Each outlet to dispense the salt or pepper is on opposing sides. A baffle is placed opposite each outlet so as to deflect and retain the contents of the unwanted compartment while shaking the dispenser to release the desired contents on the opposing side. Either condiment can be individually dispensed in this way. This dispenser is rigid and not intended to be squeezed. This dispenser would be inapplicable for liquids.

A U.S. Pat. No. 4,984,715, issued to Green is a two compartment squeeze bottle intended to expel the contents without inverting the bottle. Inverting the squeeze bottle is essential to apply condiments downward onto food. The intended embodiment is for toothpaste or an epoxy and catalyst dispenser. This container does not have a means to adjust the size of the nozzles for each chamber. Each nozzle also has a separate cap for sealing.

A U.S. Pat. No. 5,332,112, issued to Blocker describes a double partitioned bottle for storing contents, whether liquid or particulate. It is not intended to be squeezed to dispense its contents. It has two hinged seals at the top of the bottle that are held in a closed unsealed position with a screw on cap. This bottle could not function as a dispenser for liquid condiments.

A U.S. Pat. No. 5,921,440, issued to Maines is a dual, or multi-compartment container intended for use as a condiment dispenser. It has a rotatable cap that allows for the dispensing of either compartment individually, or together. In any of the three possible configurations that this cap provides, there is no provision to adjust the size of the nozzle openings. A compartment selected is either fully open or fully closed. This would not allow contents of dissimilar viscosities to dispense equally or in desired proportions.

A U.S. Pat. No. 6,583,103, issued to Klinkhammer describes a two chamber bottle for dispensing a two part cleaning solution from each chamber in equal amounts. Equal dispensing is essential to this patent. There is no provision for adjusting the flow when two liquids of different viscosities are present in the separate chambers.

A U.S. Pat. No. 6,758,411, issued to Conway, et. al. also describes a two chamber bottle for dispensing a two part cleaning solution from each chamber in equal amounts as in the above patent. Equal dispensing is essential to this patent. There is no provision for adjusting the flow when two liquids of different viscosities are present in the separate chambers.

A need exists for a squeezable condiment dispensing bottle capable of holding two compatible condiments, such as mustard and ketchup, or vinegar and oil, that will allow dispensing in proportions that are compatible with one's preference. The convenience provided by having two condiments in one dispenser is enhanced when the dispensing nozzles can be adjusted to vary the amount of condiment flow from the nozzles. The reason to have the ability to adjust the nozzle size is because the pressure inside both chambers is the same when the bottle is squeezed. Two nozzles of equal dispensing area will dispense equal amounts of condiment from each chamber when the viscosities of the condiments are the same. But that is seldom the case. Mustard is often thinner than ketchup, and as a result flows more freely than ketchup. Similarly, vinegar flows much more freely than oil. What is needed is the ability to vary the size of the orifice of the nozzle to restrict the flow of the thinner, or less viscous, condiment to the proportion desired for dispensing. Further, a simple, convenient way to make this adjustment while dispensing removes any trial and error in attempting to preset the nozzle openings prior to dispensing.

SUMMARY OF THE INVENTION

An object of this invention is to provide a convenient and quick way to dispense two liquid condiments at the same time. A further object of this invention, during the dispensing of two liquid condiments at the same time, is the ability to vary the nozzle openings to account for different viscosities of the condiments. This allows one to adjust the proportion of the flow of the condiments as desired.

This invention is a condiment bottle made from a squeezable plastic material that has the ability to return to its original shape after squeezing. It has two chambers that allow for two compatible condiments, such as mustard and ketchup, to be dispensed together. The head of the bottle contains a nozzle for each chamber. A further object of this invention is the ability to vary the size of the opening of each nozzle by turning the appropriate valve for each nozzle. One can make these adjustments during dispensing for a more precise flow of condiments of different viscosities. Either condiment can be dispensed independently of the other, by rotating the valve for the unwanted condiment to the closed position. The bottle can be made from a transparent or translucent plastic material to help identify the condiments of each chamber.

A further object of this invention is the shape of each nozzle opening. Each nozzle opening is shaped into a narrow rectangular slot or aperture that discourages leakage of each condiment chamber when the bottle is inverted. This feature prevents the inadvertent release of the condiments until the bottle is squeezed. The valves maintain an airtight fit with the valve housing to prevent leakage of the condiments except through the narrow rectangular slots or apertures of each nozzle. Further, when the valves are rotated to the closed position, the airtight fit prevents the drying out of the condiments, both in the valves and in the chambers. This eliminates the need for separate caps on each nozzle. A clear plastic cover is fitted over the head of the bottle to assist in providing an airtight seal and make convenient stacking of the bottles possible. Both the bottom of the dual chambered bottles and the plastic covers are flat for stable stacking of several bottles. Further, the condiment bottles can be stored in an inverted position, thereby retaining the condiments at their respective nozzles for immediate use.

DETAILED DESCRIPTION OF THE INVENTION

Figure 1:
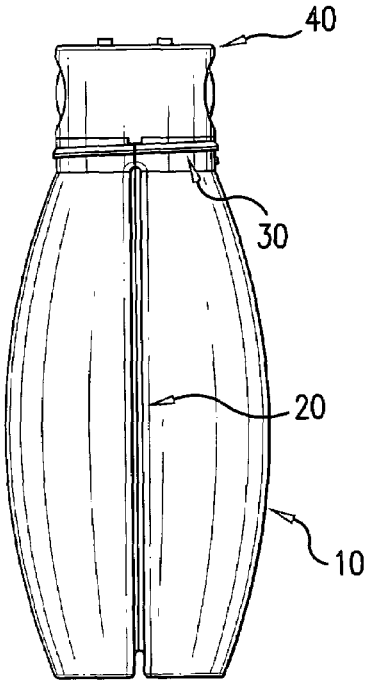
FIG. 1 is a side view of the condiment bottle illustrating the two separate chambers.
Figure 2:
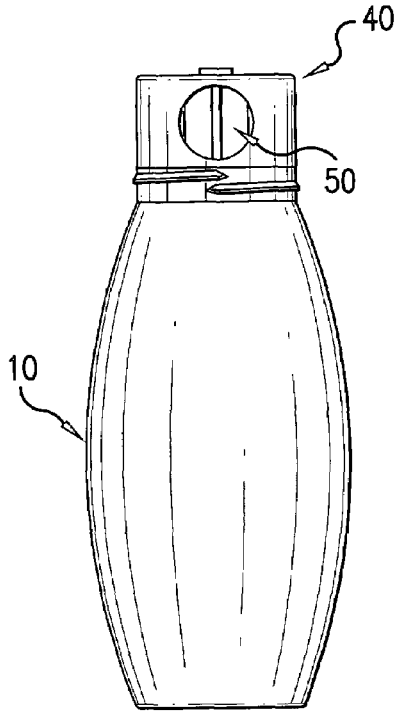
FIG. 2 is a 90 degree axial rotation of FIG. 1.
Figure 3:
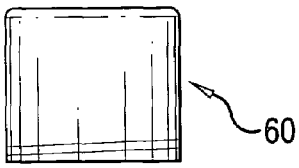
FIG. 3 is a side view of the transparent cap.

The current invention is a dual chambered condiment bottle 10 represented in FIG. 1. FIG. 2 is a ninety degree rotation about the vertical axis of the condiment bottle 10. As seen in FIG. 1, the condiment bottle 10 is divided into two sections by chamber divider 20. Condiment bottle 10 can be molded from polyethylene or polypropylene, but not limited to those materials alone. Any plastic or other material can be used provided that the material used has the property of being able to return to its original shape after being squeezed to force ejection of the desired amount of condiment(s). A threaded portion 30 is molded at the top of the condiment bottle 10 to engage the corresponding threaded portion molded in transparent cap 60 represented in FIG. 3. The threaded portion 30 is molded on the outside surface at the top of the condiment bottle 10. Likewise, the corresponding threaded portion molded in transparent cap 60 is on the inside surface of the cap 60. The threaded portion molded in the transparent cap 60 in FIG. 3 is shown as a right hand thread requiring a clockwise rotation as seen from above to tighten the cap 60 to the top of the condiment bottle. Conversely, a counterclockwise rotation as seen from above is required to unscrew the cap 60 from the top of the condiment bottle 10. The bottom of condiment bottle 10 and the top of the transparent cap 60 are both fiat and parallel to each other. This gives the condiment bottle 10 the additional convenience of allowing the stacking of other condiment bottles 10 in either an upright or inverted position.

Valve housing 40 of FIG. 1 and FIG. 2 is affixed to the top of the condiment bottle 10 by a press fit or mutually keyed or mated molded means on top of the open chamber halves. Further, mutually keyed or mated molded tabs or slots provide assurance that the valve housing 40 aligns itself so that each valve 50 represented in FIG. 2 is in a fixed position over each chamber half. The flexible material of condiment bottle 10 allows the valve housing 40 to be easily removed and replaced for filling and cleaning. Each valve 50 can be individually rotated to regulate the amount of condiment desired as condiment bottle 10 is squeezed.

Figure 4:
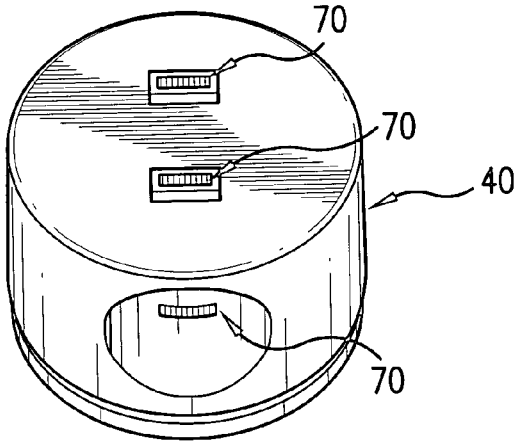
FIG. 4 is an oblique view of the valve housing.

FIG. 4 represents valve housing 40 and rectangular slots or apertures 70. In this preferred embodiment, typical dimensions of the rectangular slots or apertures 70 are 1 mm. by 5 mm. Depending on the viscosity of the condiments used, these dimensions may vary to suit the task at hand.

Figure 5:
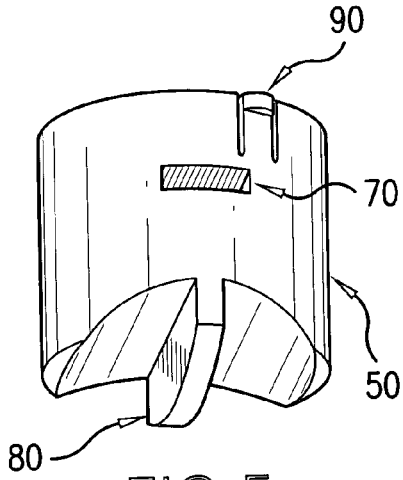
FIG. 5 is an oblique view of the valve.

FIG. 5 illustrates valve 50 with finger tab 80. Finger tab 80 provides a convenient means to rotate valve 50 to control the amount of condiment being dispensed. Valve 50 in FIG. 5 shows the rectangular slot or aperture 70 that aligns with the rectangular slots or apertures 70 in the valve housing 40 of FIG. 4. The rotation of valve 50 by finger tab 80 changes the relative positions of the rectangular slots or apertures 70 in valve 50 with the rectangular slots or apertures 70 in the valve housing 40. One Maximum alignment occurs when the rectangular slots or apertures 70 of valve housing 40 and valve 50 are completely aligned allowing for the maximum flow of the condiment. In less than a completely open position, the rectangular slots or apertures 70 do not align, restricting the flow of the condiment. The finger tab 80 allows one to continuously vary the rotation of the valve 50 between a completely open position to a completely closed position in order to regulate the desired amount of condiment needed. When valve 50 is inserted into valve housing 40, locking tab 90 rides inside of a mating groove molded inside valve housing 40 to retain valve 50 and to limit the extent of its rotation to be anywhere between a completely open position and a completely closed position. The locking tab 90 is flexible and able to be depressed toward the rotational axis of the valve 50, allowing for the easy removal and replacement of valve 50 for cleaning.

Figure 6:
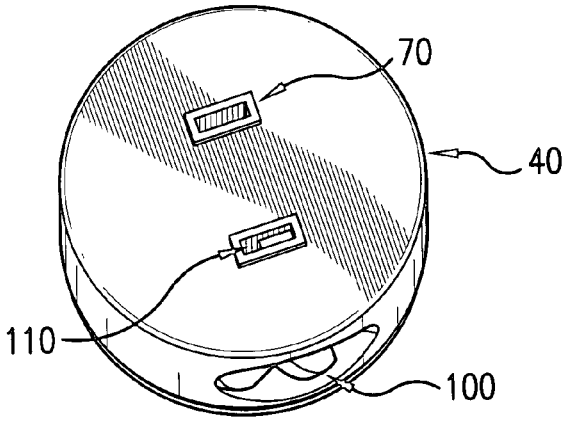
FIG. 6 is an oblique view of the valve located in the valve housing partially rotated to a closed position.

FIG. 6 illustrates a partially rotated valve 100 between a fully open position and a fully closed position. As a result, a partially closed rectangular slot or aperture 110 is illustrated in FIG. 6.

The foregoing description of a preferred embodiment of the invention has been presented for purposes of illustration and description, and is not intended to be exhaustive or to limit the invention to the precise form disclosed. The description was selected to best explain the principles of the invention and practical application of these principles to enable others skilled in the art to best utilize the invention in various embodiments and various modifications as are suited to the particular use contemplated. It is intended that the scope of the invention not be limited by the specification, but be defined by the claims set forth below.

I claim:

1. A dual liquid condiment dispenser bottle, comprising:

a. a squeezable bottle having two separate chambers, defined by a flat wall dividing the bottle into two separate halves;

b. a dual valve housing with two rectangular slots or apertures, each rectangular slot or aperture positioned over one of said two separate chambers through which the condiments are to flow upon squeezing said liquid condiment dispenser bottle, said dual valve housing affixed to the top of said liquid condiment dispenser bottle by a press fit or mutually keyed or mated molded means;

c. two rotating valves, each one having a flexible locking tab that rides inside a mating groove inside said dual valve housing for the express purpose of retaining each said rotating valve in position to maintain alignment with a corresponding rectangular slot or aperture in each said rotating valve and said rectangular slots or apertures located in said dual valve housing;

d. a finger tab on each rotating valve to provide the external means with which to rotate each valve separately;

e. an external threaded portion molded on the exterior of the neck of the squeezable bottle; and f. a cap having a threaded portion that corresponds to said external threaded portion on the neck of said squeezable bottle, said cap fitting over said dual valve housing.

2. The dual liquid condiment dispenser bottle of claim 1, wherein said squeezable bottle is made of a plastic that resumes its original shape after the squeezing is completed.

3. The dual liquid condiment dispenser bottle of claim 1, wherein said cap top is in a single flat plane parallel to the base of the squeezable bottle.

* * * * *